United States Patent [19]

Dunn, Sr.

[11] Patent Number: 4,824,174

[45] Date of Patent: Apr. 25, 1989

[54] SEATING DEVICE

[76] Inventor: Richard A. Dunn, Sr., 2440 Kuhio Ave., Ste. 1701, Honolulu, Hi. 86815

[21] Appl. No.: 188,916

[22] Filed: May 2, 1988

[51] Int. Cl.[4] ..... A47C 7/02

[52] U.S. Cl. ..... 297/453; 297/458; 297/DIG. 1

[58] Field of Search ..... 297/459, DIG. 3, DIG. 1, 297/453, 458

[56] References Cited

U.S. PATENT DOCUMENTS

| | | | |
|---|---|---|---|
| 484,367 | 10/1892 | Hicks | 297/DIG. 3 |
| 2,156,629 | 5/1939 | Hutchinson | 297/459 |
| 2,199,479 | 5/1940 | Cappel | 297/459 |
| 2,412,112 | 12/1946 | Wood et al. | 297/459 |
| 2,571,209 | 10/1951 | Cramer | 297/DIG. 3 |
| 2,855,986 | 10/1958 | Engelen, Sr. | 297/459 X |
| 3,205,010 | 9/1965 | Schick | 297/458 |
| 3,698,764 | 10/1972 | Geddings | 297/377 |
| 4,132,228 | 1/1979 | Green | 297/459 |
| 4,643,481 | 2/1987 | Saloff et al. | 297/458 |
| 4,718,727 | 1/1988 | Sheppard | 297/459 |

*Primary Examiner*—Francis K. Zugel

*Attorney, Agent, or Firm*—Richard C. Litman

[57] ABSTRACT

A seat device for alleviating backache symptoms by a laminated structure of rigid material covered by resilient material. The rigid material may be preferably wood or plastic and the resilient lamination may be from rubber. The shape includes a spacing portion from the back portion to a point considerably short of the front rim. The spacing portion is shaped on a T with an enlargement section to accommodate the genital area of a seated person. The back portion is designed to alleviate stress and pain on the coccyx of the seated person which is responsible for major backache symptoms. The enlargement area allows for circulation to the genitals and anus for proper ventilation of the genitals to avoid excessive persiration in these areas.

5 Claims, 1 Drawing Sheet

SEATING DEVICE

BACKGROUND OF INVENTION

Backache is an extremely common complaint, characterized by local or generalized pain anywhere in the spinal region, from the neck to the buttocks. It may be caused by various disorders most common are those associated with muscles, ligaments, bones or nerves and inflammation of a nerve.

The spinal column has flexible discs between vertebrae, that act like shock absorbers to cushion the bones from each other during ordinary bodily activities. Each disc has a hard outer layer and soft jelly-like core. With strain or injury pressure may extrude some of this soft substance through weak points and cause pressure against a nerve to cause pain and pain may be indicative of extrusion.

Coccygeal Pain is a term used to describe backache that is located in the area of the Coccyx at the very base of the spinal column. It is a continuous ache that is worse when sitting down.

Coccygodynea is persistent, severe pain in the lowest area of the spine, the coccyx. The pain increases during defecation and when sitting but is reduced, or absent, when a person stands. The condition may last for many months following an injury to the Coccyx. The commonest way to injure the coccyx is by falling heavily backward in a sitting position.

Sciatica is a pain caused by pressure on the sciatic nerve the biggest of all the nerves, with branches through the lower body and legs as it leaves the spinal cord. One may feel a burning painshooting into the buttocks and down the back of the thigh.

Some backache can originate or be aggravated when sitting for prolonged periods of time causing sweating at the anus and genital area.

Pain may be felt at the Sacrum which is a triangular bone that forms the rear part of the pelvis. It binds the two hip-bone together to transmit the weight of the body from the spine to the pelvis, when standing, but pressure on the spine is greatest when sitting and thus pain may be greatest when sitting.

It is an object of this invention to provide a cushion that relieves mechanical stress and lessing pain for a person sitting on the seating device.

It is a further object to provide a simple unitary design for such a cushion.

It is a further object to provide ventilation for the cushion to avoid perspiration in the areas critical to backache the anus and spinal area.

It is a further object to use spacing means in the cushion to accommodate circulation in the genitals.

It is an object to provide a rigid backing for a resilient lamination in the cushion.

It is an object to provide a soft cushion lamination to the seating device.

It is an object to provide a simple means for self help for backache.

RELATED PATENTS

U.S. Pat. No. 2,366,680 to J.S. Valentine et al is drawn to a cushion like seating pad adapted to be mounted on a rigid carrier that extends entirely beneath the pad, which is torroidal.

U.S. Pat. No. 2,855,986 to B.J. Engelen, Sr. is drawn to a cushion supplement to automobile cushions for relieving pressure on the lower portions of the spine.

This new cushion comprises parallel segments in horizontal and vertical parts of the cushion. There are recesses that extend through the middle of these parts. The recess extends completely through to the front rim of the horizontal part of the cushion.

U.S. Pat. No. Des. 256,870 to A. Britzman is drawn to a pillow cover having for a pillow with a spacing between legs of the cushion. The spacing is uniform throughout with an enlargement for the genital area.

U.S. Pat. No. Des. 261,681 to J.W. Chandler is drawn to an orthopedic pillow with hole having completely circular rim within the perimeter of the pillow.

U.S. Pat. No. Des. 284,436 is drawn to a basically circular pillow with a chordal section removed and an oval section removed from the midportion of the pillow.

U.S. Pat. No. 2,199,479 to J.T. Cappel is drawn to a head pillow with spacing means with an indentation for the head. The indentation is blocked from being completely through top to bottom of the pillow.

U.S. Pat. No. 4,132,228 to J.A. Green is drawn to a seat cushion with a hole completely enclosed in the cushion and indentations with contour to accommodate the human sitting form.

U.S. Pat. No. 2,156,629 to M.R. Hutchinson is drawn to a seat with two sides with spacing means extending from the front rim to the back rim.

U.S. Pat. No. 2,659,418 to O.A. Berman is drawn to a seat cushion of resilient material with somewhat random vent holes and an aperture completely through top to bottom but with a completely enclosed rim. Other embodiment are for reclining people.

DETAILED DESCRIPTION

Figures 1, 2:
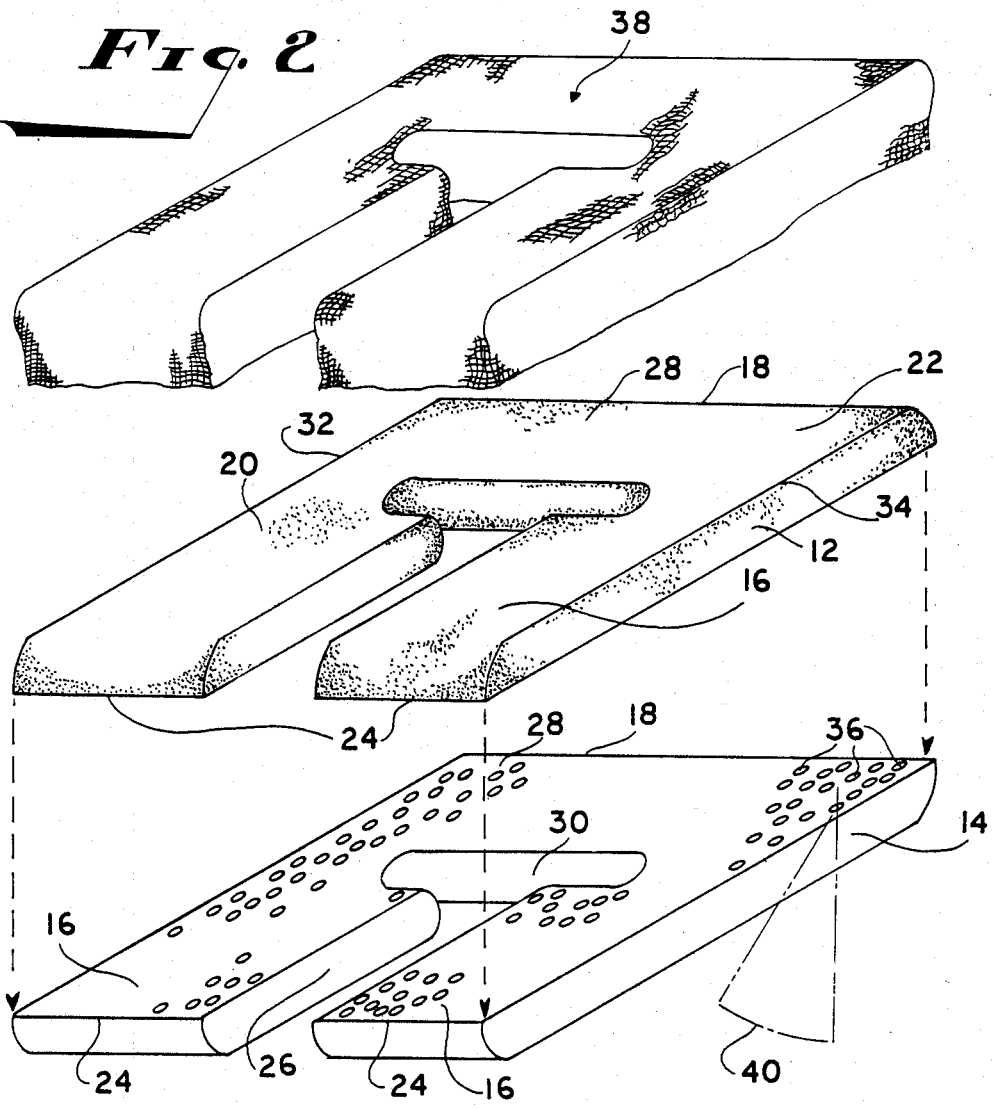
FIG. 1 is a rear perspective exploded view of the wood or plastic bottom lamination and upper foam rubber lamination.
FIG. 2 is a perspective view of the cloth cover for the laminations when they are glued together.

A seating device 10 of two or more laminations 12 and 14 shown in exploded back view in FIG. 1. The bottom or lower most lamination 14 is a monolithic rigid, wood or plastic structure. It is preferably 17 inches across its back portion 16 and front rim 18 and 12 inches along the side portions 20 and 22 between the front rim 18 and back rim 24. The top or upper most lamination 12 is the same shape as the above described lower most lamination 14 but made of resilient foam rubber.

There is a spacing or opening 26 in the back portion 16 extending inwardly toward the front portion 28 but terminating well before reaching the front rim 18 in a transverse enlargement section 30 such that a substantially T-shaped cut-out will be seen to be formed through both laminations. The opening 26 in the back portion 16 of the seat alleviates stress on the coccyx of a person using the seating device 10. The enlargement section 30 of the spacing opening 26 allows freer circulation to the genital area of a seated person. The back of the enlargement section is preferably 9 inches from the back rim 24 of the seating device 10.

The front portion 28 is unbroken and extends completely across the front rim 18 inward to the enlargement section 30 from the front rim 18 and laterally extends to the side rims 32 and 34.

There is a cloth or vinyl cover 38 as shown in FIG. 2 that fits over the laminated seat structure 10 of the upper lamination 12 and lower lamination 14. The upper laminations 12 may be glued to the lower lamination 14. The lower lamination 14 has carefully dispersed holes 36 either molded, in the case of a plastic material, or drilled in the case of wood being used for the lowr lamination 14. At least three of the holes 36 adjacent the front rim 18 extend downwardly at a 30 degree angle 40.

As can be seen, the assembled seat is one integral structure 10 with no struts between the side portions 20 and 22 at the back portion 16. This arrangement allows maximum ventilation at the anus, vagina and scrotum, minimizing perspiration in these areas. The carefully located drilled or molded holes 36 allow more circulation down through the upper, compressible or resilient layer 12 and through the lower layer 14 where the holes 36 are located for ventilation and heat reduction or dissipation. The T-shaped enlargement section 30 of course allows for movement of the seated person while still keeping the scrotum and other genitals unencumbered. All of these arrangements minimize perspiration and also allow for circulation to the areas critical to backache prevention.

I claim:

1. A seating device for alleviating backache including;

top and bottom laminations assembled together and defining front and back portions and two side portions, an entire front rim and a back rim on said laminations, said passageway extending from said back rim completely through said laminations in said back portion for allowing a seated person's coccyx to be relatively free of mechanical stress and pain, said passageway comprising two openings, a first longitudinal one said opening extending inwardly of said device and joined with a second transverse one said opening perpendicular to said first opening said two openings together defining a substantially T-shaped configuration allowing freer flowing circulation of air to the genital area of a seated person, said front rim being completely extensive across the entire front portion of said seating device between said side portions, a plurality of holes disposed within said bottom lamination for venting purposes, said top lamination made of compressible foam material enhancing heat reduction, at least certain of said plurality of holes disposed adjacent to said front rim angled downwardly and inwardly at substantially a 30 degree angle to the vertical thereby increasing air flow when said top lamination is compressed, and said plurality of holes including holes adjacent said two openings to increase ventilation to the genital area of a seated person.

2. A seating device according to claim 1 wherein;

said top lamination comprising a single composition resilient material providing cushioning, said bottom lamination comprising a rigid support material, and said top and bottom laminations congruent in plan and permanently affixed to each other.

3. A seating device according to claim 1 including;

a cover of pliable material encircling said assembly of laminations.

4. A seating device according to claim 1 wherein;

said front rim and said back rim are beveled.

5. A seating device according to claim 1 wherein;

said first opening extends substantially greater then half the length of said side portions and said second transverse opening extending substantially greater than half the width of said front and back poritons.

* * * * *